United States Patent [19]

Lo

[11] 4,266,943

[45] May 12, 1981

[54] STABILIZERS FOR OIL-WATER MIXTURES

[75] Inventor: Shih H. Lo, Central, Hong Kong

[73] Assignee: Farsan Enterprises Limited, Hong Kong

[21] Appl. No.: 95,408

[22] Filed: Nov. 19, 1979

[30] Foreign Application Priority Data

Nov. 17, 1978 [GB] United Kingdom ..... 45082/78

[51] Int. Cl.[3] ..... C10L 1/18; C10L 1/30

[52] U.S. Cl. ..... 44/51; 44/68; 44/76; 44/70; 252/351; 252/353; 252/356

[58] Field of Search ..... 44/51, 68, 67, 76, 78, 44/70; 252/351, 353, 356

[56] References Cited

U.S. PATENT DOCUMENTS

| | | | |
|---|---|---|---|
| 4,104,036 | 8/1978 | Chao et al. | 44/68 |
| 4,139,349 | 2/1979 | Payne | 44/68 |

*Primary Examiner*—Patrick Garvin
*Assistant Examiner*—J. V. Howard
*Attorney, Agent, or Firm*—Ostrolenk, Faber, Gerb & Soffen

[57] ABSTRACT

A stabilizing agent which produces stable fuel oil-water mixtures for use as fuels with consequent fuel savings comprises:

| | |
|---|---|
| a combustible emulsifier | 6 to 11.5 parts by weight |
| ferrocene | 4 to 9 parts by weight |
| magnesium (as an oil-soluble magnesium salt) | 4.5 to 9.2 parts by weight |
| anionic surfactant | 1.4 to 3 parts by weight |
| benzoic acid | 0 to 12 parts by weight |
| in an oil-based liquid medium. | |

23 Claims, No Drawings

STABILIZERS FOR OIL-WATER MIXTURES

This invention relates to stable oil-water mixtures for use as fuel; to a stabilizing agent for use in the formation of such mixtures; and to a method of forming such mixtures.

In the current energy crisis, it is generally considered essential to conserve fossil fuels as much as possible by greater economy in usage. The remaining supplies have only a limited life and are not replaceable. In the field of heavy fuel oil, e.g. oil for use in domestic and industrial heating boilers, it has been proposed to mix a proportion of water with the oil in order to extend it and thus to conserve oil supplies. The water may act purely as a diluent, or may actually benefit the combustion by taking part in the chemical reactions which occur at high temperatures. In either event, less fuel is burnt for the production of the same amount of heat and thus oil supplies are conserved. However, the problem is to provide a stable dispersion of water in oil which can be burnt as a fuel without adversely affecting the burner. The oil-water mixture must form a relatively stable emulsion which does not immediately separate before it has a chance to be burnt and which should preferably be able to be stored for some time. Many additives which might stabilize such a mixture are deleterous to burner installations and would cause corrosion or blockage.

I have now found a particular mixture of compounds which can be used in combination with water to render the water almost totally miscible with fuel oil to provide a stable dispersion which can be used as a fuel and which comprises up to 30 to 40, or even 50% by volume of water.

According to the invention, there is provided a stabilizing agent for an oil-water mixture comprising the following components:

| | |
|---|---|
| A combustible emulsifier | 6 to 11.5 parts by weight |
| Ferrocene | 4 to 9 parts by weight |
| Magnesium (as an oil-soluble magnesium salt) | 4.5 to 9.2 parts by weight |
| An anionic surfactant | 1.4 to 3 parts by weight |
| Benzoic acid | 0 to 12 parts by weight |
| in an oil-based medium. | |

The emulsifier should be a combustible emulsifier which is oil-soluble and which is non-toxic. The emulsifier is preferably a mixed glyceride, that is to say a mixture of mono-, di- and triglycerides of fatty acids with 12 to 20 carbon atoms in the acid moiety. The glycerides may be based on one or more fatty acids and are conveniently based on a number of fatty acids derived from a naturally occurring triglcyeride. The glyceride mixture preferably has as low an iodine value as possible and is preferably hydrogenated.

The emulsifier should preferably be present in an amount of 6.6 to 11 parts by weight, particularly about 6.7.

The magnesium should be present in the form of an oil-soluble magnesium salt. The magnesium salt is preferably a magnesium naphthenate. The magnesium salt is used in conjunction with anionic surfactant, in particular a long chain alkylene sulphonate. These last two components are conveniently added to the stabilizing agent mixture as a joint solution in an oil medium. Such a solution is commercially available, for example under the Trade Name Apex No. 851, which is sold in Taiwan by Panta Development Co., Ltd. The magnesium is preferably present in an amount of from 5.6 to 8.4 parts by weight, preferably about 7 parts by weight and the anionic surfactant is preferably present in an amount of from 1.6 to 2.4 parts by weight, preferably about 2 parts by weight.

The benzoic acid is an optional component, that is to say it may be present or may be absent up to the specified content. It is preferably present in an amount of 6 to 9 parts by weight preferably about 6.7 parts by weight. Its role appears to be to aid burning and to further stabilize the oil-water mixture.

Ferrocene (i.e. dicyclopentadienyl iron) is incorporated in the stabilizing agent in order to control burning. It is important that the ferrocene is fully dissolved in oil and evenly distributed throughout the mixture for optimum effect.

The oil-based medium in which the stabilizing agent is formulated is conveniently based on fuel oil or another light oil fraction. Other solvents are preferably incorporated with the oil in order to maintain certain of the components in solution, as explained below. The stabilizing agent according to the invention preferably contains the components in the said ranges of parts by weight in 1,000 parts by weight of the solvent medium. Thus, for example, a stabilizing agent according to the invention can contain:

| | |
|---|---|
| combustible emulsifier | 6 to 11.5 g |
| ferrocene | 4 to 8 g |
| magnesium (as oil-soluble magnesium salt) | 4.5 to 9.2 g |
| anionic surfactant | 1.4 to 3 g |
| benzoic acid | 0 to 12 g |
| per liter of medium. | |

The stabilizing agent according to the invention is conveniently prepared by forming (1) a solution of the magnesium salt and the anionic surfactant in a paraffin or other moderate to high-boiling petroleum fraction solvent; (2) a solution of ferrocene in oil; (3) a solution of the emulsifier and the benzoic acid (if present) in an organic solvent system; and then combining these three solutions (1), (2) and (3) in any order. The oil used for the ferrocene is preferably fuel oil. The organic solvent for the emulsifier is conveniently an aromatic or araliphatic hydrocarbon solvent, such as benzene, toluene or xylene, especially where the emulsifier is a mixed glyceride.

The benzoic acid is preferably sepearately dissolved in a more polar solvent, for example a lower alkanol such as methanol, and then this solution added to the solution of the emulsifier to form a mixed solution in an organic solvent system containing the hydrocarbon solvent and the polar solvent.

Once the stabilizing agent has been formed, it can be stored indefinitely and is not subject to decomposition or physical separation.

The stabilizing agent is used, according to the present invention, to stabilize an oil-water mixture by adding it simultaneously with water to oil with vigorous mixing. The stabilizing agent and the water may be added separately and simultaneously, which is the preferred method, or alternatively the stabilizing agent may first be added to the water and the "stabilized" water then added to the oil. I have found that it is not so effective to add the stabilizing agent according to the invention to the oil and then add the water.

In a preferred embodiment of the method, the oil is thinned, i.e. its viscosity is reduced, before addition of the stabilizing agent and water. This can be achieved by heating the oil to a moderate temperature, for example about 30° C., by vigorous stirring with a high shearing action, or by dilution with a small amount of a thinner grade of oil.

Once formed, the oil-water mixture comprises a stable emulsion which can be stored at moderate temperatures (i.e. above freezing point and below 40° C.) for considerable lengths of time without separation.

In practice, however, the oil-water mixture is best prepared immediately before use, for example by in-line addition of the water and stabilizing agent between the fuel tank and the burner.

The oil-water mixture may contain up to 50% by volume of water although it preferably contains from 10 to 30% by volume and ideally from 18 to 25%. As the water content increases, the amount of stabilizing should also increase and, in general, the ratio of the total of the said components in the stabilizing agents to the water by weight, should be from 1:8,400 to 1:14,000. In a mixture where the said parts by weight are present in a solution in terms of grams per liter, the solution should be added in a weight ratio to water from 1:250 to 1:420.

The amount of water which can be added to the oil depends largely on the efficiency of the burner system in which the mixed fuel is to be burned. Most water-heating boilers and the like are relatively inefficient and a relatively high proportion of the fuel oil is wasted, either by being emitted unburnt or only partially burnt, thus providing less heat and causing increased polution. I have found that it is an advantage of the stabilizing agent according to this invention that the combustion efficiency of the fuel oil is improved, so that a proportion of the fuel can be replaced by water with the same amount of heat being generated. In addition, the more efficient combustion produces less undesirable polution in the form of soot, carbon monoxide etc.

The ability to replace 20% or more of the fuel oil by water and still obtain the same amount of heat, especially coupled with decreased polution, illustrates dramatically the importance of the present invention.

The following examples illustrate the invention further.

EXAMPLE 1

A stabilizing agent was prepared by dissolving 6.7 g of a mixed $C_{12}$ to $C_{20}$ fatty acid glyceride in toluene (200 ml); and benzoic acid (6.7 g) in methanol (200 ml); and combining the two solutions. Ferrocene (7.3 g) was dissolved in about 500 ml of fuel oil and this solution was mixed with the previously formed solution containing the benzoic acid and glycerides. Also added to the mixture was Apex No. 851 (100 ml), found to contain magnesium (7 g) in the form of an oil-soluble magnesium salt including the naphthenate, and an anionic surfactant of the sulphonate type (2 g). The combined mixture was stirred well and added simultaneously with 334 liters of water to fuel oil. A 1:3 by volume water in oil mixture and a 1:4 by volume water in oil mixture were prepared. The mixtures were stable and could be stored at ambient temperature (25° to 35° C.) for several weeks without separation.

EXAMPLE 2

Comparison of oil-water mix and fuel oil

A 1:4 water-oil mixture was compared with pure fuel oil in heating 100 liters of water from 25° C. to 95° C.

A standard heating apparatus was used in which pre-heated oil was injected under pressure into a combustion chamber. The initial internal temperature of the chamber was adjusted to 100° C., the water temperature to 25° C. and the pre-heated temperature to 90° C. The oil pressure was 2 kg/cm$^2$. In each run, the air intake and oil injection rate were adjusted to provide the optimum setting for smoke-free combustion. For each run, the initial fuel volume was measured, the remaining fuel volume was measured and hence the amount of fuel used was obtained. In the test, the results obtained as an average of two runs were as follows:

| | |
|---|---|
| Fuel consumption | |
| heavy fuel oil | 6.5 kg |
| water-oil mixture | 6.4 kg |
| Combustion chamber temperature | |
| heavy fuel oil | 860° C. |
| water-oil | 890° C. |
| time required to raise from 25° C. to 95° C. | |
| heavy fuel oil | 24 minutes 30 seconds |
| water-oil mixture | 24 minutes 15 seconds |

The results show that the two fuels produce almost exactly the same amount of heat for the same volume consumed. As the water-oil mixture contained 20% water, this results in a saving of 20% of the fuel.

The combustion chamber temperature was found to be 30° C. higher, but the overall heating time was substantially similar, thus showing that the heat evolved was the same. The oil-water mixture had a viscosity of 1.6 times that of the pure oil and the pre-heater needed to be set 10° higher in order to obtain the same rate of flow.

EXAMPLE 3

Using the same apparatus as in Example 2, but with a 1:3 water-oil mixture, the amount of fuel and the time required to boil a given volume of water from an initial temperature of 18° C. were measured.

During the runs, the combustion chamber temperature on average was found to be 70° C. higher for the water-oil mixture than for the pure oil. The rate of rise in temperature is shown in the following Table.

| Minutes | Temperature A | Temperature B |
|---|---|---|
| 0 | 18 | 18 |
| 2 | 31 | 30 |
| 4 | 39 | 36 |
| 6 | 46 | 44 |
| 8 | 54 | 50 |
| 10 | 63 | 58 |
| 12 | 73 | 67 |
| 14 | 78 | 75 |
| 16 | 85 | 80 |
| 18 | 93 | 85 |
| 21 | 100 | 93 |
| 23 | — | 100 |

For the heating runs, the average amount per run of pure oil used was 5 kg and the average amount per run of water-oil mixture used was 5.23 kg of which 3.975 kg was oil.

From these results it will be seen that at a 1 to 4 ratio, 20.5% of fuel is saved. Since the heating time is in fact reduced, the actual fuel saving is, in fact, greater than 20.5%. In addition, the combustion flame was clear orange as opposed to being orange-red and smokey.

I claim:

1. A stabilising agent for an oil-water mixture comprising the following components:

| | |
|---|---|
| a combustible emulsifier | 6 to 11.5 parts by weight |
| ferrocene | 4 to 9 parts by weight |
| magnesium (as an oil-soluble magnesium salt) | 4.5 to 9.2 parts by weight |
| anionic surfactant | 1.4 to 3 parts by weight |
| benzoic acid | 0 to 12 parts by weight |
| in an oil-based liquid medium. | |

2. A stabilising agent according to claim 1, in which the emulsifier is a mixed glyceride containing mono-, di and triglycerides of fatty acids with 12 to 20 carbon atoms.

3. A stabilising agent according to claim 1, in which the emulsifier content is 6.6 to 10 parts by weight.

4. A stabilising agent according to claim 1 in which the ferrocene content is 6 to 8 parts by weight.

5. A stabilising agent according to claim 1, in which the magnesium salt is magnesium naphthenate.

6. A stabilising agent according to claim 1, in which the magnesium salt content corresponds to 5.6 to 8.4 parts by weight magnesium.

7. A stabilising agent according to claim 1, in which the benzoic acid content is 6 to 9 parts by weight.

8. A stabilising agent according to claim 1, in which the oil-based medium contains fuel oil.

9. A stabilising agent according to claim 1, containing

| | |
|---|---|
| combustible emulsifier | 6 to 11.5 g |
| ferrocene | 4 to 8 g |
| magnesium (as oil-soluble magnesium salt) | 4.5 to 9.2 g |
| anionic surfactant | 1.4 to 3 g |
| benzoic acid | 0 to 12 g |
| per liter of medium. | |

10. A stabilising agent according to claim 9, containing

| | |
|---|---|
| mixed fatty acid glycerides | 6.6 to 10 g |
| ferrocene | 6 to 8 g |
| magnesium (as an oil-soluble salt) | 5.6 to 8.4 g |
| anionic surfactant | 1.6 to 2.4 g |
| benzoic acid | 6 to 9 g |
| per liter of medium. | |

11. A method of forming a stabilising agent according to claim 1, preparing:

(1) a solution of the magnesium salt and the anionic surfactant in a paraffin solvent (2) a solution of ferrocene in oil (3) a solution of the emulsifier and the benzoic acid in an organic solvent system; and combining the three solutions (1), (2) and (3).

12. A method according to claim 11, in which the oil is a fuel oil.

13. A method according to claim 11, in which the emulsifier is dissolved in an araliphatic hydrocarbon solvent and the benzoic acid in a lower alkanol and the two solutions are combined.

14. A method of forming a stabilised oil-water mixture, comprising simultaneously adding water and the stabilising agent set forth in claim 1 to oil with vigorous mixing.

15. A method according to claim 14, in which the stabilising agent is first added to the water and the combined mixture added to the oil.

16. A method according to claim 14, in which the ratio of agent to water is such that the ratio of the total of the said components to the water, by weight, is from 1:8,400 to 1:14000.

17. A method according to claim 14, in which an agent according to claim 9 is added at a weight ratio to water of 1:250 to 1:420.

18. A method according to claim 14, in which water is combined with oil to give a product containing up to 50% water by volume.

19. A method according to claim 18, in which the product contains 10–30% water by volume.

20. A method according to claim 18, in which the product contains 18 to 25% water by volume.

21. A method according to claim 14, in which the oil is thinned to reduce its viscosity before addition of the agent and the water.

22. A stabilised oil-water mixture containing a stabilising agent according to claim 1.

23. A stabilizing agent according to claim 1 in which the anionic surfactant content is 1.6 to 2.4 parts by weight.

* * * * *